United States Patent [19]

Balekjian

[11] 4,016,450

[45] Apr. 5, 1977

[54] PHOSPHORESCENT DISPLAY SYSTEM

[76] Inventor: Garbis S. Balekjian, P.O. Box 749, Burbank, Calif. 91503

[22] Filed: Jan. 8, 1976

[21] Appl. No.: 647,586

[52] U.S. Cl. ..... 315/149; 40/130 L; 40/134; 250/365; 250/461 R; 250/462; 315/159

[51] Int. Cl.[2] ..... H05B 37/02

[58] Field of Search ..... 315/149, 151, 159; 240/2.25, DIG. 6; 328/2; 250/205, 365, 461, 462, 483, 484; 40/130 L, 130 M, 134

[56] References Cited

UNITED STATES PATENTS 2,486,859 11/1949 Meijer ..... 250/462 X 3,038,271 6/1962 MacHutchin et al. ..... 40/130 M

*Primary Examiner*—Eugene R. LaRoche

*Attorney, Agent, or Firm*—Poms, Smith, Lande & Glenny

[57] ABSTRACT

A sign having phosphorescent indicia, a light source providing ultraviolet radiation for illuminating the sign and charging the phosphorescent indicia, and a photoelectric sensor responsive to the level of the phosphorescent glow of the indicia for briefly energizing or flashing the light source whereby to effectively recharge the phosphor when the light level of the glow decays below a predetermined value.

7 Claims, 2 Drawing Figures

PHOSPHORESCENT DISPLAY SYSTEM

BACKGROUND AND SUMMARY OF THE INVENTION

This invention relates generally to electrically illuminated display devices or signs, and more particularly to a sign including phosphorescent material having the capability of glowing for a substantial period after being exposed to ultraviolet radiation, incorporated into a system for cyclically recharging the phosphorescent material to maintain the light level produced by the glow at or above a given desired value.

It is well known that phosphor materials have the property of providing a visible glow while energized by a source of ultraviolet or blacklight radiation. Such phosphors exhibit afterglows whose light levels typically decay after removal of the energizing blacklight radiation. The rates of decay differs substantially among phosphors, and those preferred for use in the present invention have comparatively slow rates of decay, such as those including zinc sulfide activated by trace elements such as silver, copper or cadmium.

In accordance with the present invention, there is provided a sign having indicia which are desirably visible under ordinary illumination including sunlight, the indicia having the additional property of including slow-decaying phosphors similar to the types just mentioned. The present system includes an illuminating or activating light source, desirable in the form of an ultraviolet lamp such as a fluorescent lamp of known construction and characteristics. The system includes control means in the form of a photoelectric sensor responsive to the light level of illumination coming from the phosphorescent indicia, or a part thereof, and serving to energize the lamp when that light level decays below a predetermined value. The latter value will, of course, be established in accordance with the minimum desired visibility standard of the particular display involved. In the preferred form of the invention hereinafter described and illustrated, the photoelectric sensor serves in conjunction with a flasher of conventional construction to briefly energize the lamp and thereby to illuminate the phosphor material and thus recharge such material.

The display device of the present invention may include any suitable power supply adapted for producing power at the proper voltage and frequency for activating the lamp. Thus the power supply may be a dc source powered by batteries and including a conventional inverter for producing the necessary ac power, or the power supply may be fed from a conventional 60 cycle ac line. Alternatively, and particularly where the present device is used in an outdoor installation, a solar power generator is desirable and makes the entire installation independent of externally supplied power. Because the illuminating lamp is activated for only a short period of time during a cycle of recharging, the entire system is very economical in power consumption.

Accordingly it is a principal object of the present invention to provide and disclose a novel display device including a system for cyclically recharging the luminous material of the device. Other objects of the invention are to provide, in such a system, control means in the form of a photelectric sensor responsive to the light level emanating from a phosphor portion of a display device; to disclose in such a system a phosphor having a slow rate of decay of phosphorescence after removal of the exciting source of radiation; and for other and additional purposes as will be understood from a study of the following description of a preferred embodiment of the invention, taken in connection with the accompanying drawing.

DETAILED DESCRIPTION

Figure 1:
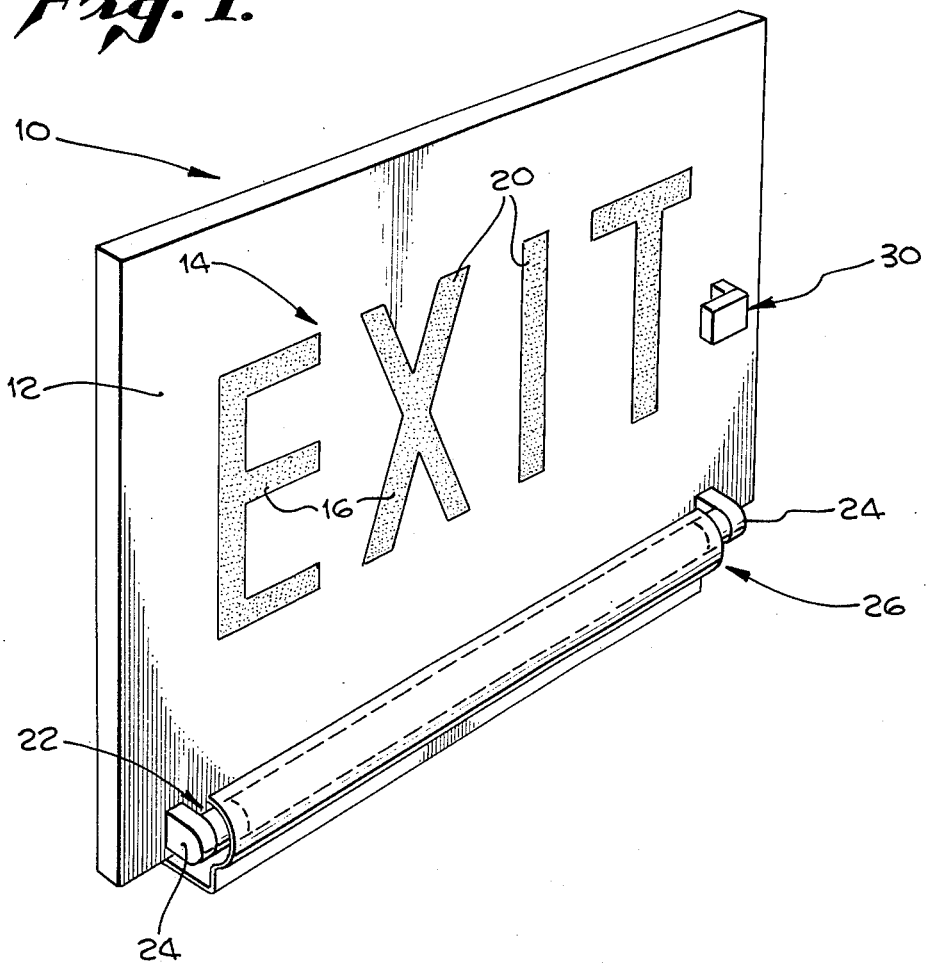
FIG. 1 is a perspective view of a display device including luminous or phosphorescent indicia, used in the present invention.

Referring now to the drawing, there is indicated generally at 10 in FIG. 1 a display device or sign as used in the present invention, which is here illustratively shown as having a generally flat front surface 12, carrying thereon desired indicia indicated generally at 14, here in the form of the letters EXIT. Each of the letters of the indicia is defined or outlined by lines 16 having a color under ordinary visible light contrasting with the color of the front surface 12, which constitutes the background of the sign. Thus the message conveyed by the indicia of the sign is visible to an observer under ordinary light such as sunlight. For example, the outlining lines 16 may be a dark color such as black and the front surface 12 of the sign may be of a light color such as white.

Within the area defined by the outlining lines 16 on the front surface 12 there is provided a quantity of phosphorescent material 20 characterized by having a slow rate of decay of its luminosity or output of visible light, following activation. The material 20, for example, may be zinc sulfide including trace elements such as silver, copper or cadmium, or other slow-decaying phosphors known in the art.

Means are provided in accordance with the invention for activating the phosphor material 20, and such means are here illustratively shown as an ultraviolet lamp indicated generally at 22 and mounted by suitable conventional means 24 in relationship with sign 10 in order that the radiation from lamp 22 will strike the phosphor material 20. A reflector housing indicated generally at 26 may be provided, partially surrounding lamp 22, in order to concentrate the radiation from the lamp upwardly as seen in the drawing on to the phosphor portions of the sign. Lamp 22 may be any suitable source of blacklight illumination, being rich in the ultraviolet portion of the spectrum and desirable producing little or no radiation of the type which tends to quench the luminous phosphorescent material 20, such as infrared radiation.

Means are provided in accordance with the invention for sensing the light level of luminous output of the phosphorescent material 20 in the visible portion of the spectrum. Such means are here shown as a photoelectric cell indicated generally at 30, suitably mounted in the present form of the invention on the front surface 12 of the sign, in such a position as not to interfere with activating radiation from lamp 22, and to be continuously responsive to the visible luminosity of phosphor material 20.

Figure 2:
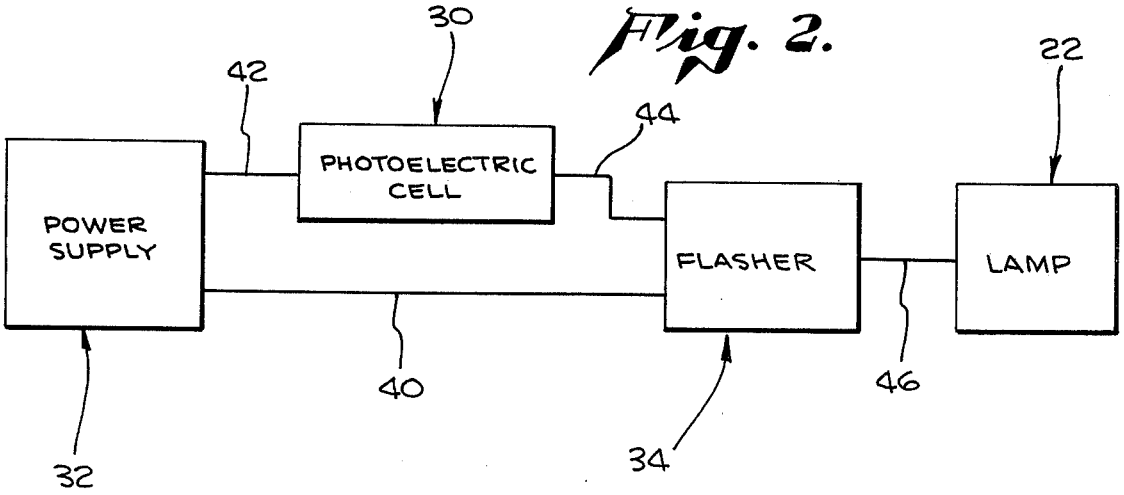
FIG. 2 is a block diagram of the major electrical components in the system.

In FIG. 2 there is shown a block diagram of the major electrical components of the invention, including a power supply indicated generally at 32, the photoelectric cell 30 previously referred to, a flasher indicated generally at 34, and the blacklight lamp 22 previously described. Power supply 32 may be of any type capable of energizing the lamp 22 and, particularly where the present invention is incorporated into a portable sign or warning device for outdoor use, a solar generator and storage battery are within the contemplation of the invention. Power supply 32 furnishes electrical power through line 40 to flasher 34 and, through line 42 to photoelectric cell 30, which via line 44 serves to control actuation of flasher 34. The latter element, when activated by the appropriate signal in line 44, feeds energizing power via line 46 to lamp 22.

It will accordingly be seen that, when lamp 22 has been energized, its radiation will activate the luminous phosphor material 20 of the sign. The visible light output of the phosphorescent material is continuously sensed by the sensor means 30. When the light level of such visible output of the phosphor decays down to a predetermined value of visibility, the sensor of photoelectric cell 30 produces a signal in line 44 which causes flasher 34 to pass energizing power from line 40 to line 46 and thus to lamp 22, whereby the ultraviolet blacklight radiation of the lamp serves to again activate the luminous material 20. Desirably the sensor means 30 may be responsive not only to the visible light output of phosphor material 20, but also to visible light from an external source such as sunlight, which may be reflected from an adjacent portion of surface 12 of the sign. Thus sensor 30 will not activate flasher 34 if the sensor is receiving such light from an external source which makes the indicia of the sign visible, such as by the contrasting colors of lines 16 and surface 12.

Modifications and changes from the illustrative form of the invention hereinabove described are within the contemplation of the invention. In particular, details of circuitry as such may be modified as desired for adaptation to a particular environment, characteristics of a selected phosphor and other parameters.

I claim:

1. A phosphorescent display system comprising:
a phosphor material;
a source of activating radiation in operative relation with said material;
a power supply for energizing said source;
selectively actuatable control means for momentarily operatively connecting the power supply to said source;
and sensor means responsive to the luminosity of the phosphor material for actuating the control means.

2. The invention as defined in claim 1 wherein the phosphor material is characterized by having a slow decay rate.

3. The invention as defined in claim 2 wherein said control means constitutes a flasher.

4. The invention as defined in claim 2 including means providing a display surface, said phosphor material covering a portion of said surface.

5. The invention as defined in claim 4 wherein the phosphor material is arranged to form indicia on said surface.

6. The invention as defined in claim 5 wherein said surface is relative to ambient light, and the indicia are visibly distinguishable from adjacent portions of the surface.

7. The invention as defined in claim 6 wherein the sensor means is also responsive to ambient visible light reflected from at least a portion of said surface adjacent to the phosphor material.

* * * * *